US011338414B2

(12) United States Patent
Hsieh

(10) Patent No.: US 11,338,414 B2
(45) Date of Patent: May 24, 2022

(54) BENDABLE TORQUE WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 246 days.

(21) Appl. No.: 16/733,417

(22) Filed: Jan. 3, 2020

(65) Prior Publication Data

US 2020/0238484 A1 Jul. 30, 2020

(30) Foreign Application Priority Data

Jan. 30, 2019 (TW) ..... 108103564

(51) Int. Cl.
*B25B 23/00* (2006.01)
*B25B 23/142* (2006.01)

(52) U.S. Cl.
CPC ..... *B25B 23/0007* (2013.01); *B25B 23/1427* (2013.01)

(58) Field of Classification Search
CPC ..... B25B 23/1427; B25B 23/0007
USPC ..... 81/477
See application file for complete search history.

(56) References Cited

U.S. PATENT DOCUMENTS 4,488,442 A * 12/1984 Pacinelli ..... B25B 23/1427 73/862.21
6,009,732 A * 1/2000 Haeck ..... E05B 65/1053 70/92
6,928,955 B1 * 8/2005 Rokos ..... A01K 5/025 119/61.5
8,259,987 B2 * 9/2012 Omoda ..... H04R 7/14 381/423
9,452,517 B2 * 9/2016 Hsieh ..... B25B 23/1427
2017/0209993 A1 * 7/2017 Owen ..... B25B 23/1427
2018/0050441 A1 * 2/2018 Fang ..... B25B 23/1427

* cited by examiner

*Primary Examiner* — Orlando E Aviles
*Assistant Examiner* — Jason Khalil Hawkins
(74) *Attorney, Agent, or Firm* — Guice Patents PLLC

(57) ABSTRACT

A bendable torque wrench includes: a shank; a tubular body whose front end is angularly displaceable with respect to the shank about an axis defined by a first pivotal connection end of the shank; an abutting block located on one side of the tubular body, a the front end of the abutting block has a convexly curved abutting surface; and a detent member whose front end is pivotally connected to a second pivotal connection end of the shank and whose rear end forms a convexly curved contact surface in elastic contact with the curved abutting surface of the abutting block. The torque wrench bends, or collapses, rapidly when the torque applied to the torque wrench reaches a preset torque value.

11 Claims, 7 Drawing Sheets

BENDABLE TORQUE WRENCH

BACKGROUND OF THE INVENTION

1. Technical Field

The present invention relates to a hand tool and more particularly to a bendable torque wrench that bends, or collapses, when its torque value is reached.

2. Description of Related Art

A torque wrench is generally set with a predetermined torque value so that when the torque of the torque wrench reaches the predetermined torque value, the torque wrench produces a warning and thereby alerts the user that the preset target value has been reached.

Referring to FIG. 1 and FIG. 2, a conventional bendable torque wrench 10 has: a shank 12 whose rear end is formed as a pivotal connection end 13; a driving head 14 provided at the front end of the shank 12 and configured to be mounted around a socket or a threaded fastener; a diverging member 15 provided on one side of the shank 12; a connecting member 16 pivotally connected at the front end to the pivotal connection end 13 of the shank 12 by a pivot shaft 161; a housing including a tubular body 17 and a casing 18 fixedly provided on one side of the tubular body 17, with the connecting member 16 extending through the tubular body 17; a detent member 20 mounted in the casing 18 and pivotally connected at the front end to the diverging member 15 by a pivot shaft 201 so as to be angularly displaceable, wherein the body of the detent member 20 is provided with an arcuate positioning groove 21; a rivet 22 riveted to the casing 18 and extending into the positioning groove 21 of the detent member 20; and an abutting block 23 provided in the casing 18 such that a curved surface 202 of a bottom portion of the detent member 20 abuts against the block 23. In addition, a torque adjustment mechanism 24 is mounted in the tubular body 17 and includes: a hollow fixed block 25, an elastic element 26, and an adjusting member 28. The fixed block 25 is mounted around a slender portion 162 of the connecting member 16 and is fixed in, and hence immovable with respect to, the tubular body 17. The adjusting member 28 is threadedly connected to the rear end of the slender portion 162 of the connecting member 16 and is exposed through the rear end of the tubular body 17. The elastic element 26 is mounted in the tubular body 17 and has its two ends abutting against the fixed block 25 and the adjusting member 28 respectively. The desired torque of the wrench 10 can be set by rotating the adjusting member 28.

To use the wrench 10 on a threaded fastener, the driving head 14 is mounted around the threaded fastener, before a force F is applied to the handle 29 of the wrench 10 in order to rotate the wrench 10 and consequently the threaded fastener. During the process, the force F is gradually increased, and once the force F overcomes the elastic force of the elastic element 26, the housing (including the tubular body 17 and the casing 18) is slid toward the rear end of the connecting member 16, with the fixed block 25 displaced along with the tubular body 17 and thus compressing the elastic element 26, resulting in angular displacement of the detent member 20. In other words, when the force applied by the wrench 10 reaches the preset torque, the housing and the related components (including the connecting member 16 and the detent member 20) are pivoted to one side of the wrench 10 about the two pivot shafts 161 and 201. In the meantime, the rivet 22 is displaced to the other end of the positioning groove 21 of the detent member 20. The sight of the shank 12 and the housing bent with respect to each other helps inform the user that the preset torque has been reached and that the wrench 10 need not be operated any further.

In the course in which the wrench 10 applies its torque, the position where the curved surface 202 of the bottom portion of the detent member 20 contacts the abutting block 23 is changed by the angular displacement of the detent member 20. By the time the wrench 10 reaches the preset torque, the curved surface 202 of the detent member 20 has been angularly displaced from the outer side of the abutting block 23 to the inner side of the abutting block 23. As the portion of the abutting block 23 that is in contact with the detent member 20 is a flat surface, the angular displacement of the detent member 20 along the abutting block 23 is slow and smooth. The slow angular displacement of the detent member 20 leads to slow bending of the housing with respect to the shank 12, as indicated by the relatively smooth curve in FIG. 8A. As a result, the torque applied by the wrench 10 vanishes slowly; that is to say, there is still a certain amount of torque applied to the threaded fastener after the preset torque is reached. It follows that the threaded fastener may be torqued excessively.

If the torque of the wrench can vanish rapidly upon reaching the preset torque value, not only will the user be more certain about the variation of the torque value of the wrench, but also the threaded fastener will be protected from a larger torque than the preset torque after the latter is reached.

BRIEF SUMMARY OF THE INVENTION

The primary objective of the present invention is to provide a bendable torque wrench that bends rapidly after a preset torque value is reached, thereby allowing the torque of the wrench to vanish rapidly and the collapsed state of the wrench to be more noticeable than that of the prior art.

The present invention provides a bendable torque wrench that includes: a shank provided with a driving head at the front end and a first pivotal connection end and a second pivotal connection end at the rear end, wherein the first pivotal connection end and the second pivotal connection end are spaced apart;

a tubular body, a front end of which can be angularly displaced with respect to the shank about an axis defined by the first pivotal connection end of the shank, wherein the tubular body is provided therein with an elastic element;

an abutting block provided on one side of the tubular body, wherein the abutting block is provided with a convexly curved abutting surface at the front end; and a detent member pivotally connected at the front end to the second pivotal connection end of the shank so as to be angularly displaceable in a casing about an axis defined by the second pivotal connection end, wherein the detent member is provided with a convexly curved contact surface at the rear end, the curved contact surface is in contact with the curved abutting surface, the elastic element urges the abutting block to contact the detent member elastically, the detent member can be angularly displaced with respect to the abutting block when the wrench is rotated, and the shank and the tubular body can be bent with respect to each other.

Preferably, the detent member has a positioning groove with a first end, a second end, and a transition between the first end and the second end, and a position limiting member is at the transition when the curved contact surface of the detent member is at the apex of the curved abutting surface of the abutting block.

Preferably, a stop block is located on one side of the curved abutting surface, and the detent member is configured to abut against a lateral side of the stop block.

The bendable torque wrench of the present invention features a detent member that has a curved contact surface and an abutting block that has a curved abutting surface. With the two curved surfaces in contact with each other, the detent member will rotate rapidly along the abutting block when the torque of the torque wrench reaches the preset torque value, thus enabling the torque wrench to bend rapidly without applying any residual torque to the threaded fastener being fastened with the torque wrench. The bending of the torque wrench also prevents the user from exerting a force that exceeds the preset torque value.

BRIEF DESCRIPTION OF THE SEVERAL VIEWS OF THE DRAWINGS

The objectives, technical features, and effects of the present invention can be better understood by referring to the following detailed description of a preferred embodiment in conjunction with the accompanying drawings, in which.

DETAILED DESCRIPTION OF THE INVENTION

Figure 3:
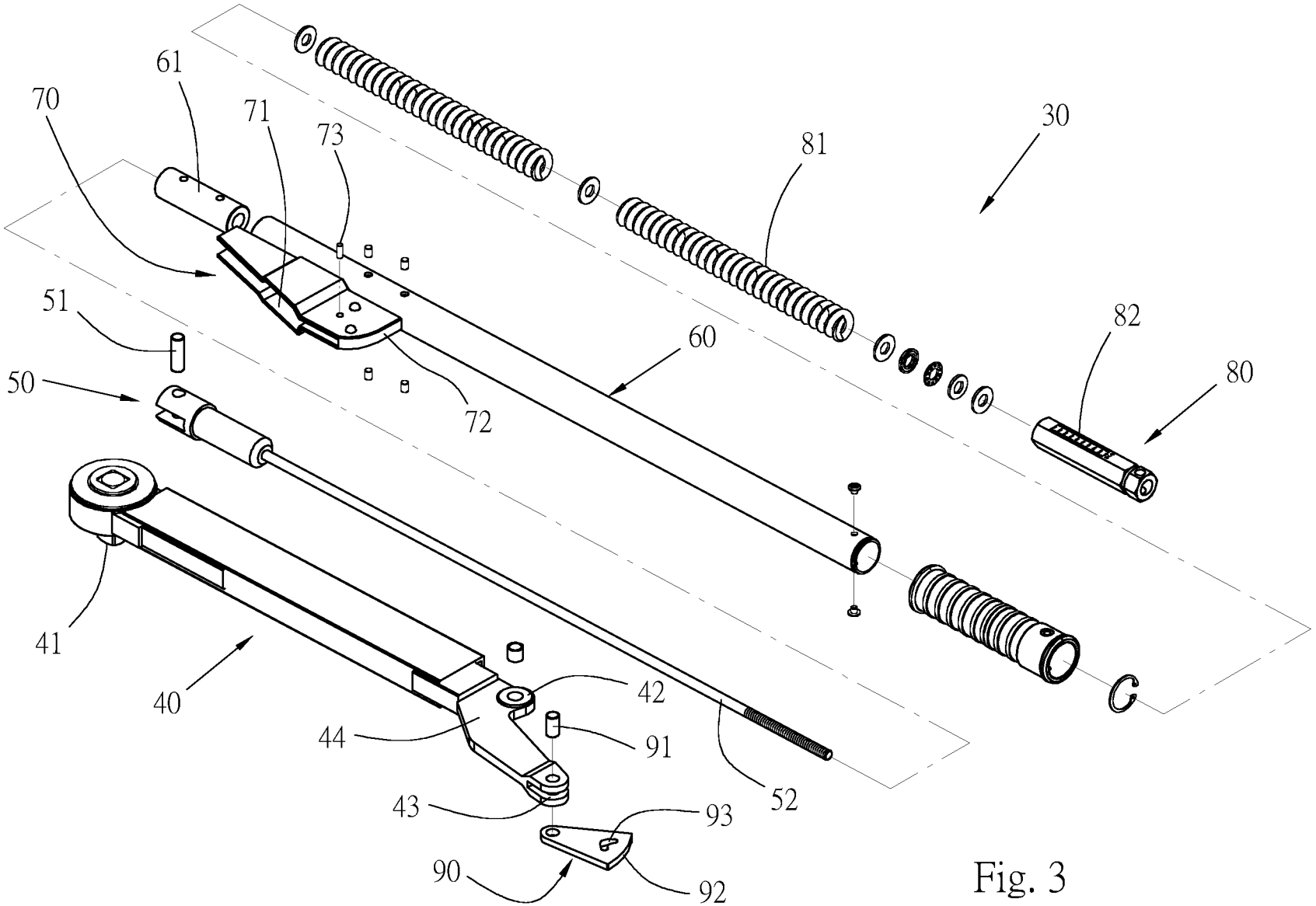
FIG. 3 is an exploded perspective view of the bendable torque wrench according to a preferred embodiment of the invention.
Figure 4:
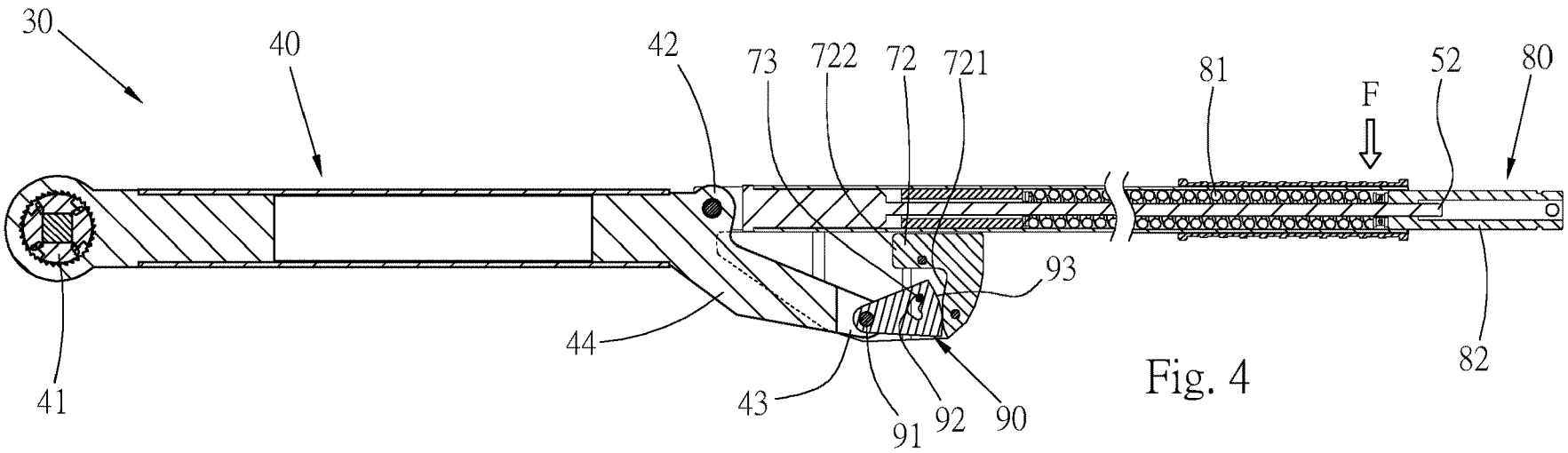
FIG. 4 is an assembled sectional view of the bendable torque wrench in FIG. 3.

Please refer to FIG. 3 and FIG. 4 for the bendable torque wrench 30 according to a preferred embodiment of the present invention. The bendable torque wrench 30 includes a shank 40, a connecting member 50, a housing, a torque adjustment mechanism 80, and a detent member 90.

The shank 40 is provided with a driving head 41 at the front end and can be used to rotate a threaded fastener (e.g., a nut or a bolt) through the driving head 41. The configuration of the driving head may vary as needed. A first pivotal connection end 42 and a second pivotal connection end 43 are provided at the rear end of the shank 40. A diverging member 44 is provided between the first pivotal connection end 42 and the second pivotal connection end 43 to keep a proper distance between the two pivotal connection ends.

The connecting member 50 is pivotally connected at the front end to the first pivotal connection end 42 of the shank 40 and can therefore be angularly displaced with respect to the shank 40 about an axis defined by the first pivotal connection end 40. The rear end of the connecting member 50 is a threaded slender portion 52.

The housing includes a tubular body 60 and a casing 70 fixedly provided on one side of the tubular body 60. The tubular body 60 is fixedly provided therein with a fixed block 61. The connecting member 50 is inserted into the tubular body 60, extends through the fixed block 61, and can be moved along the axial direction of the tubular body 60. The slender portion 52 of the connecting member 50 is inserted into the tubular body 60 too. The casing 70 defines a receiving space 71 therein. An abutting block 72 and a position limiting member 73 are fixedly provided in the receiving space 71. The abutting block 72 is provided with a convexly curved abutting surface 721 at the front end. The curved abutting surface 721 is formed by a curved surface, which may have a single curvature or multiple continuous curvatures; alternatively, the curved abutting surface is a curved surface with non-single curvature or multiple non-continuous curvatures. One side of the abutting block 72 is integrally formed with a stop block 722. The stop block 722 is protrudingly provided on one side of the curved abutting surface 721 and is adjacent to the tubular body 60.

The torque adjustment mechanism 80 has an elastic element 81 and an adjusting member 82. The front end of the adjusting member 82 is threadedly connected to the thread of the slender portion 52 at the rear end of the connecting member 50. The elastic element 81 is disposed in the tubular body 60, with its two (i.e., front and rear) ends abutting against the fixed block 61 and the adjusting member 82 respectively.

The detent member 90 is received in the receiving space 71 of the casing 70. The detent member 90 is pivotally connected at the front end to the second pivotal connection end 43 of the shank 40 by a pivot shaft 91 and can therefore be angularly displaced in the casing 70 about an axis defined by the second pivotal connection end 43. The detent member 90 is provided with a positioning groove 92. The positioning groove 92 forma a first end 921, a second end 922, and a transition 923 between the first end 921 and the second end 922. When angularly displaced, the detent member 90 is limited in position by the position limiting member 73. The rear end of the detent member 90 is formed with a convexly curved contact surface 93. The curved contact surface 93 abuts against the curved abutting surface 721 of the abutting block 72. The elastic force of the elastic element 81 is substantially applied to the abutting block 72 through the tubular body 60 such that the abutting block 72 and the detent member 90 remain in elastic contact. The curved contact surface 93 is a curved surface, which in practice may have a single curvature or multiple continuous curvatures; alternatively, the curved contact surface is a curved surface with non-single curvature or multiple non-continuous curvatures. The curvature(s) of the curved contact surface 93 may be the same as or different from the curvature(s) of the curved abutting surface 721.

FIG. 5 to FIG. 7 and FIG. 8B show how the bending angle and the torque of the bendable torque wrench 30 are changed while the torque wrench is in operation.

Figure 5:
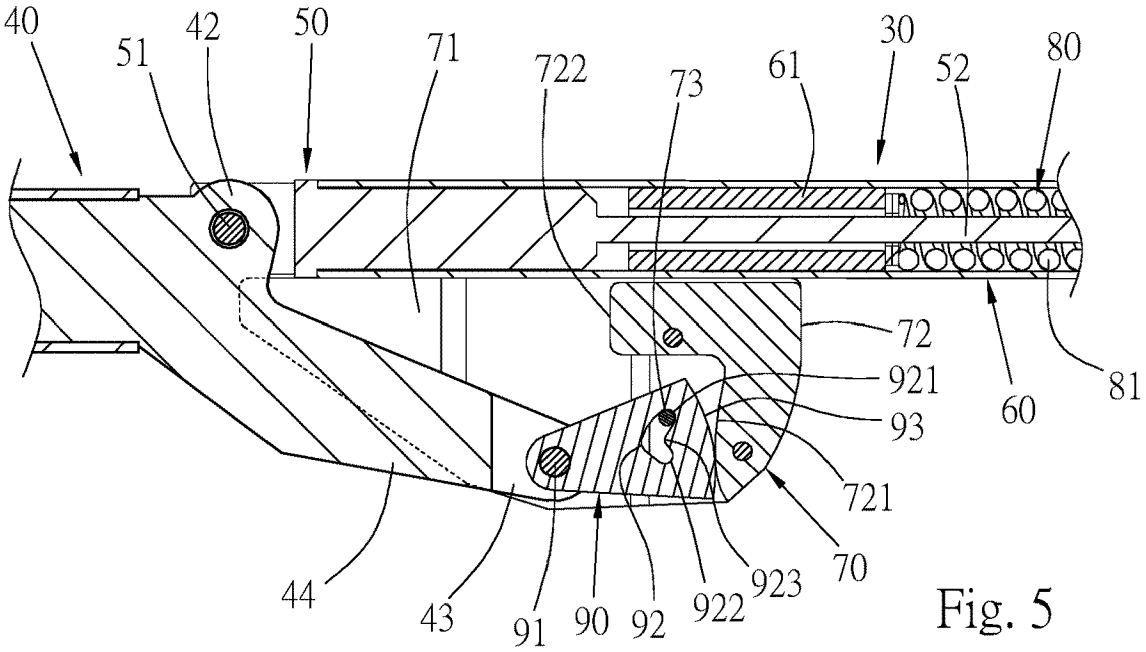
FIG. 5 is a partial enlarged view of FIG. 4, showing the positions of the detent member and the abutting lock before a force is applied to the torque wrench.

Referring to FIG. 4 and FIG. 5, a force F is applied to the torque wrench 30 in order to tighten a threaded fastener with the driving head 41 of the shank 40. Before the force applied reaches the preset torque value, the connecting member 50 is received in the tubular body 60 while subjected to the elastic force of the elastic element 81, and the shank 40 and the tubular body 60 are not bent with respect to each other. The detent member 90 in this state is at an initial angular position, where the position limiting member 73 is at the first end 921 of the positioning groove 92 of the detent member 90.

Figure 6:
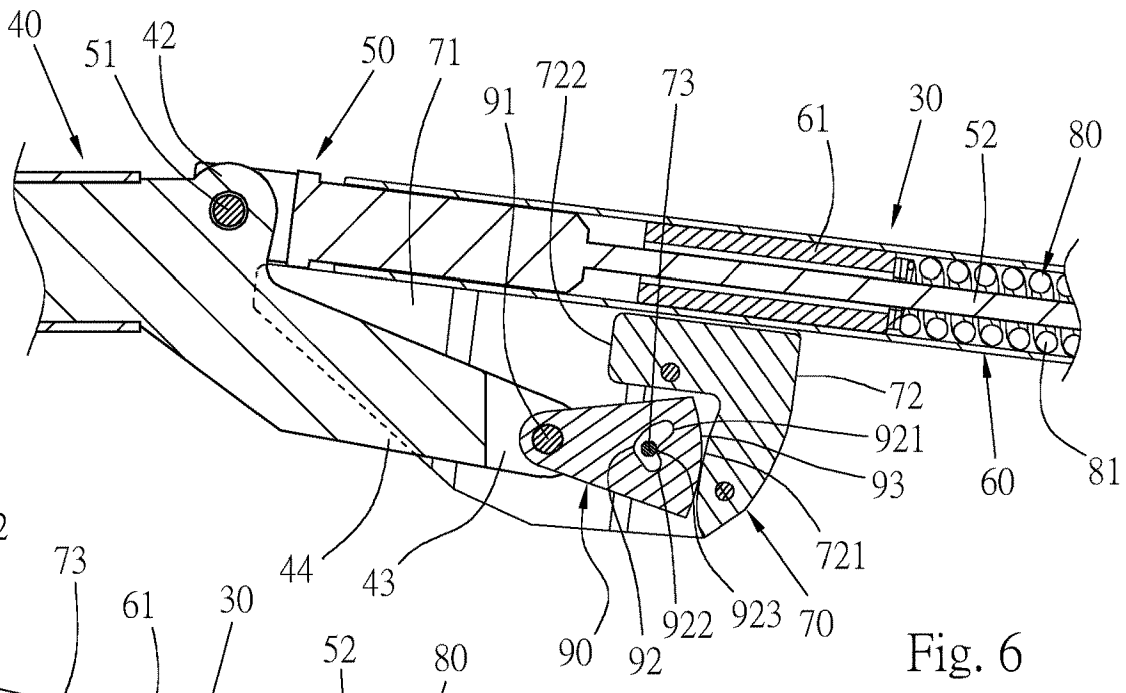
FIG. 6 is similar to FIG. 5 except that the torque wrench has bent.

When the force F reaches the preset torque value, referring to FIG. 6, the force F is large enough to overcome the elastic force of the elastic element 81 of the torque adjustment mechanism 80 and thus drives the fixed block 61 in the tubular body 60 to compress the elastic element 81 while the tubular body 60 and the casing 70 are displaced rearward. Consequently, the front end of the connecting member 50 is moved out of the tubular body 60, and the tubular body 60 is bent with respect to the shank 40, i.e., angularly displaced. Due to the relative bending (or angular displacement) of the tubular body 60, the detent member 90 is pivoted clockwise about the axis defined by the second pivotal connection end 43 (with reference to the direction shown in FIG. 6) such that not only is the position limiting member 73 moved from the first end 921 to the transition 923 of the positioning groove 92 of the detent member 90, but also the detent member 90 is brought closer to the tubular body 60. When the preset torque value is reached, the apex (i.e., the highest point) of the curved abutting surface 721 is in contact with the apex (i.e., the highest point) of the curved contact surface 93.

When application of the force F continues, so does the relative bending of the tubular body 60. The tubular body 60 and the casing 70 keep moving away from the shank 40, and the detent member 90 keeps rotating clockwise, with the position limiting member 73 moving toward the second end 922 of the positioning groove 92. While the detent member 90 is rotating, the contact between its convexly curved contact surface 93 and the convexly curved abutting surface 721 of the abutting block 72 leads to a high rotation speed of the detent member 90; as a result, the tubular body 60 is angularly displaced (or relatively bent) faster than its prior art counterparts, and the position limiting member 73 reaches the second end 922 more rapidly than its prior counterparts too. Eventually, as shown in FIG. 7, the detent member 90 is rotated to a displacement endpoint, and the tubular body 60 arrives at an angular displacement endpoint, i.e., the point at which the tubular body 60 of the wrench 30 cannot be bent, or collapsed, with respect to the shank 40 any further.

Figure 7:
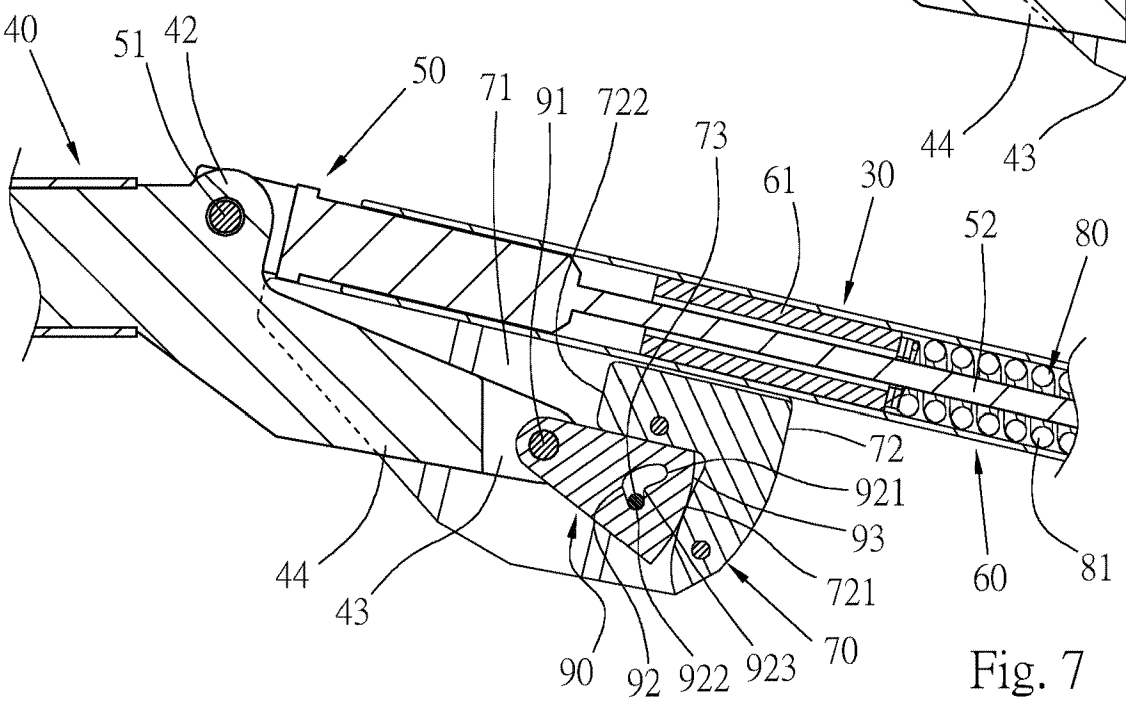
FIG. 7 is similar to FIG. 6 except that the torque wrench has reached the bending endpoint.

In the course in which the detent member 90 is rotated from the position in FIG. 6 to that in FIG. 7, the position of contact between the curved contact surface 93 and the curved abutting surface 721 of the abutting block 72 approaches the tubular body 60, and the fact that the curved abutting surface 721 is lowering at the same time causes the detent member 90 to rotate (or angularly displaced) rapidly, the shank 40 to bend with respect to the tubular body 60 rapidly, and the torque of the torque wrench 30 to vanish rapidly as a result. The cooperation between the curved abutting surface 721 and the curved contact surface 92 helps increase the rotation speed of the detent member 90 and hence the speed at which the tubular body 60 is bent with respect to the shank 40 after the preset torque value is exceeded. Now that the wrench 30 bends, or collapses, swiftly, the force applied by the wrench 30 vanishes rapidly, i.e., with little, if any, residual torque transmitted to the threaded fastener after the torque setting is reached, and this prevents torques larger than the setting from being applied to the threaded fastener. The rapid bending of the wrench can also be felt immediately by the user, allowing the user to know that the force applied by the wrench has reached the torque setting.

Moreover, this embodiment is so designed that, referring to FIG. 7, the detent member 90 arrives at one side of, and is stopped by, the stop block 722 of the abutting block 72 when reaching its angular displacement endpoint. This is the second mechanism by which to prevent the detent member 90 from further rotation (the first being the position limiting member 73), the objective being to stop the detent member 90 and the shank 40 from rotating as soon as they reach their respective angular displacement endpoints. The stop block 722 not only keeps the diverging member 44 from contact with the tubular body 60 when the wrench is bent, thus protecting the tubular body 60 from damage by colliding with the diverging member 44, but also allows the shank 40 to be bent with respect to the tubular body 60 through a relatively small angle enabled by the fact that the stop block 722 projects from the exterior of the tubular body 60 and can therefore be rapidly brought into contact with the detent member 90.

Figure 8B:
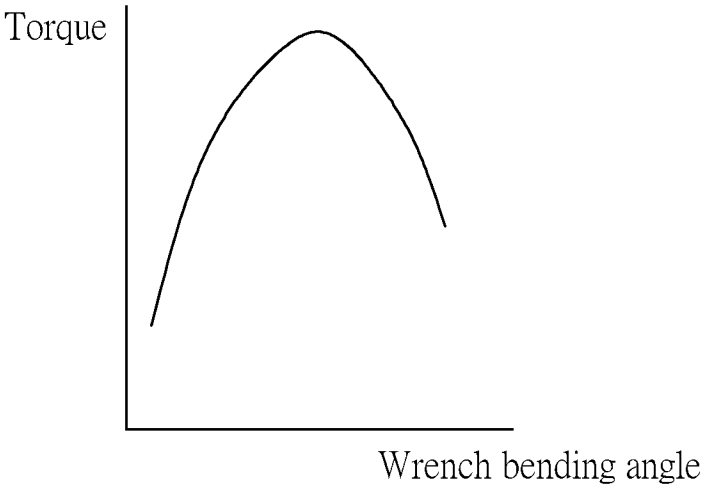
FIG. 8B shows a curve representing the relationship between the torque and the bending angle of the bendable torque wrench in FIG. 3.

Referring to FIG. 8B, the foregoing structure of the bendable torque wrench 30 of the present invention allows the tubular body 60 to bend, or collapse, with respect to the shank 40 in a noticeable manner when the torque setting (i.e., the preset maximum torque value) is reached. In addition to producing a collapsed state that can be readily felt by the user, the bending, or collapse, taking place when the torque applied to the threaded fastener reaches the torque setting converts the force applied by the user into a wrench bending/collapsing force such that the force applied to the threaded fastener is rapidly reduced. The threaded fastener, therefore, is protected from torques larger than the torque setting.

Figure 9B:
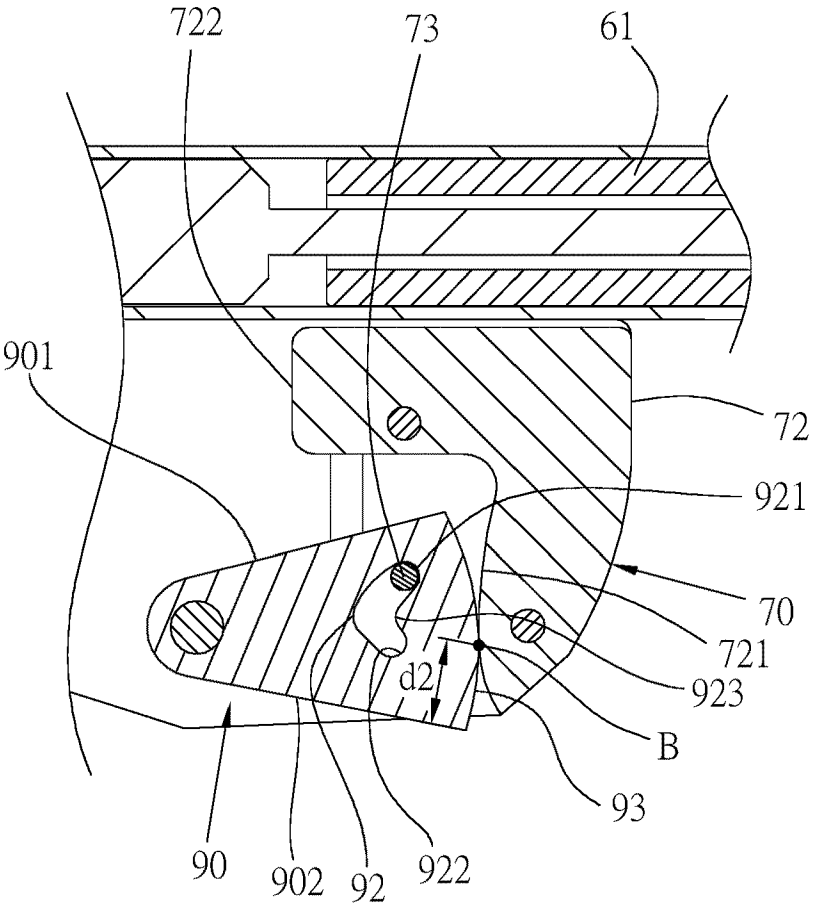
FIG. 9B is a sectional view in which the detent member and the abutting block of the invention use point B as their initial contact point.
Figure 9A:
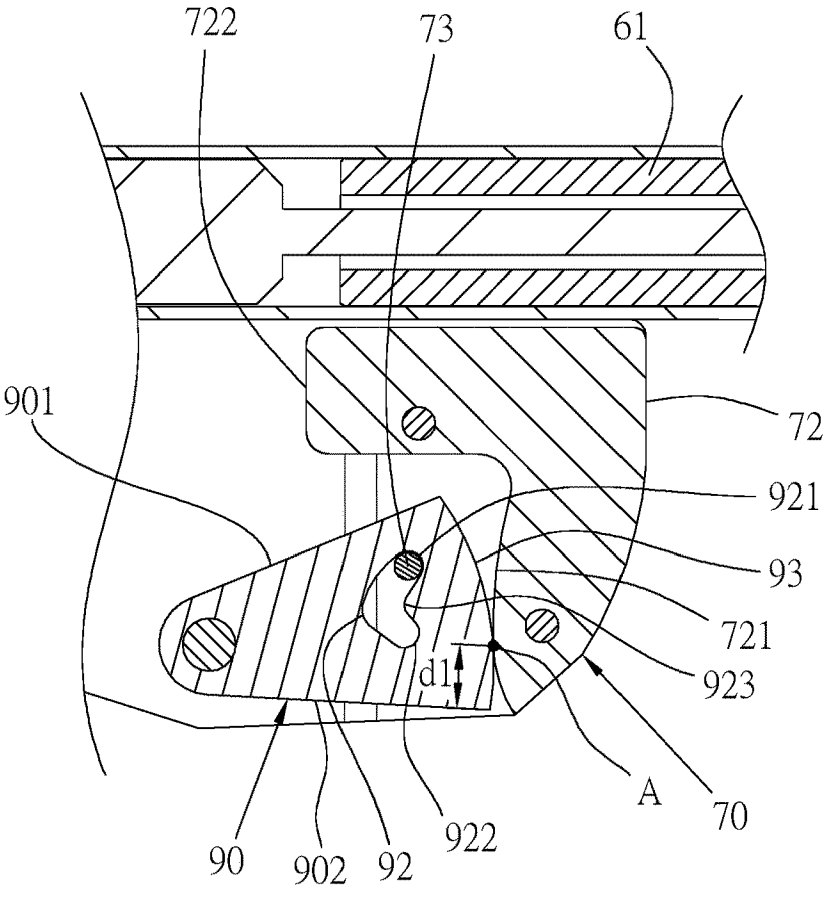
FIG. 9A is a sectional view in which the detent member and the abutting block of the invention use point A as their initial contact point.

Furthermore, referring to FIG. 9A and FIG. 9B, the initial contact point between the detent member 90 and the abutting block 72 (which point is set when the detent member 90 is mounted with respect to the abutting block 72) will affect the bending, or collapsing, angle of the tubular body 60 with respect to the shank 40. To facilitate explanation, the detent member 90 is defined as having a first side 901 and a second side 902, wherein the first side 901 is adjacent to the tubular body 60 while the second side 902 is away from the tubular body 60. In FIG. 9A, the point of contact between the curved contact surface 93 of the detent member 90 and the curved abutting surface 721 of the abutting block 72 when no force is applied to the wrench, i.e., the initial contact point, is point A, and the distance between point A and the second side 902 is d1. In FIG. 9B, the initial contact point between the curved contact surface 93 of the detent member 90 and the curved abutting surface 721 of the abutting block 72 is point B, and the distance between point B and the second side 902 is d2, wherein d2 is greater than d1. When the torque wrench bends, or collapses, due to an operating force that exceeds the torque setting, the detent member 90 in FIG. 9A will be brought into abutment against, and thus stopped by, the stop block 722 more rapidly than the detent member 90 in FIG. 9B such that the bending angle of the wrench in FIG. 9A is smaller than that of the wrench in FIG. 9B. The initial contact point B in FIG. 9B requires a longer time to be taken to bring the detent member 90 into abutment against the stop block 722 than the initial contact point A in FIG. 9A, so the bending angle of the wrench in FIG. 9B is larger than that of the wrench in FIG. 9A.

Figure 1:
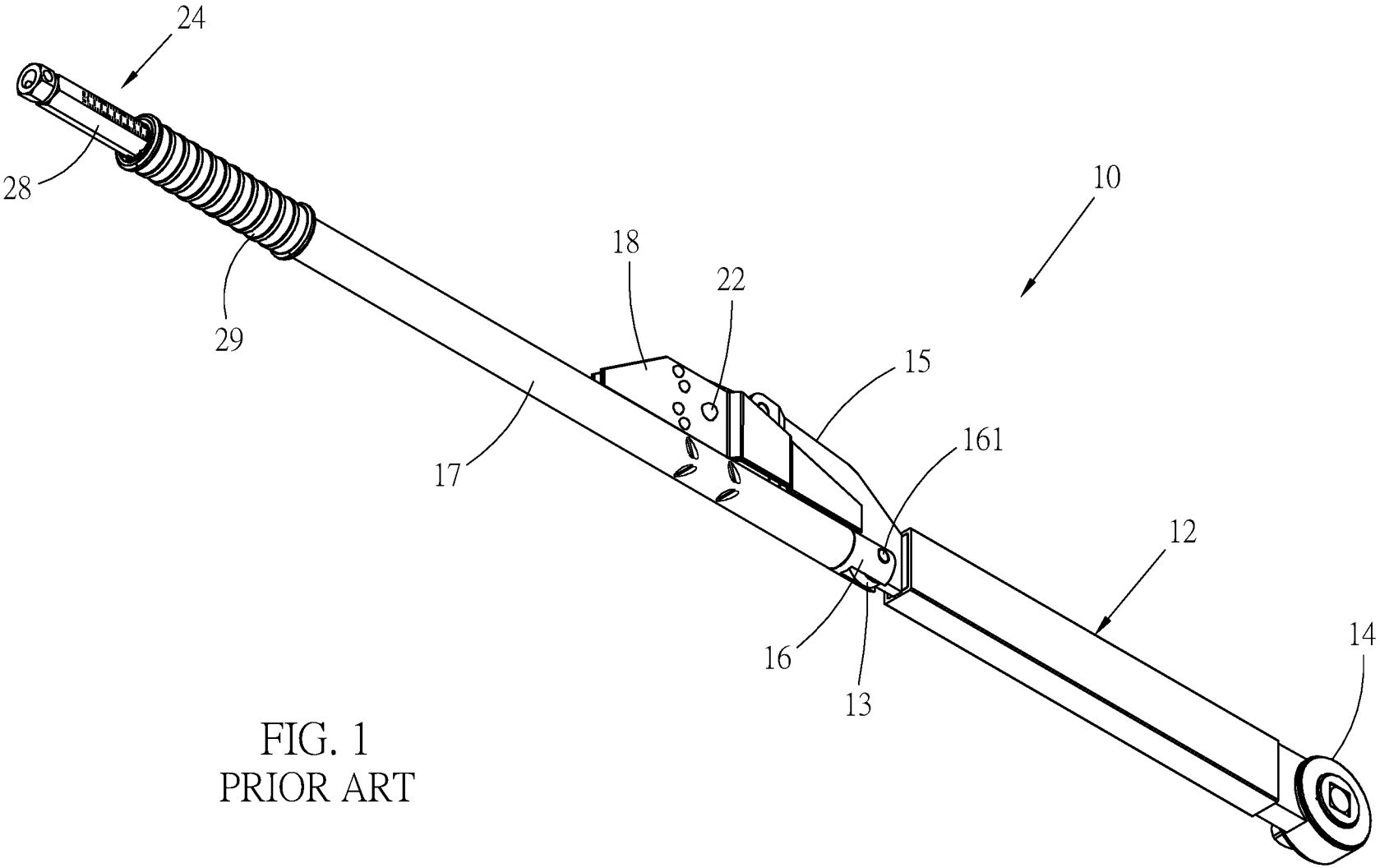
FIG. 1 PRIOR ART
FIG. 1 is a perspective view of a conventional bendable torque wrench.
Figure 2:
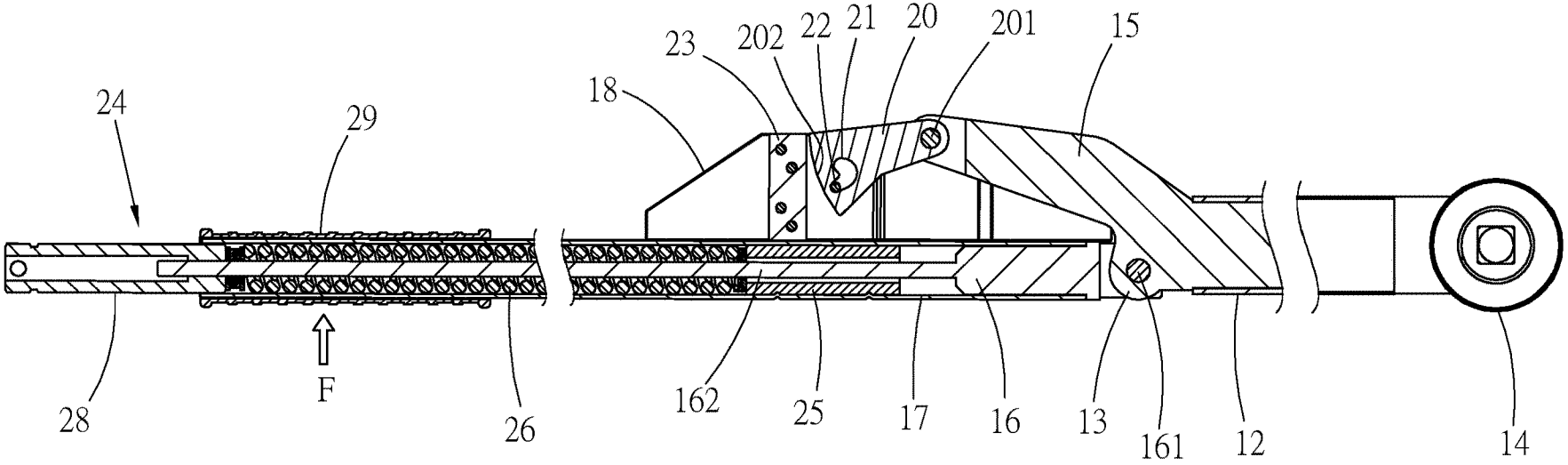
Fig. 2 PRIOR ART
FIG. 2 is a sectional view of the conventional bendable torque wrench in FIG. 1.
Figure 8A:
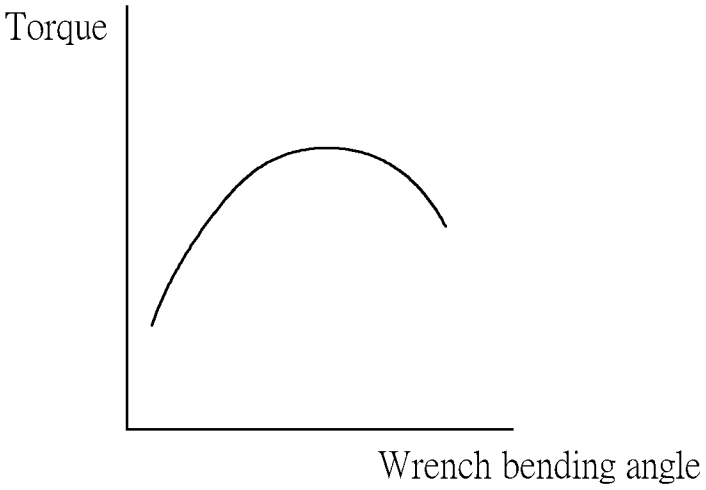
FIG. 8A shows a curve representing the relationship between the torque and the bending angle of the conventional bendable torque wrench in FIG. 1.

Referring to FIG. 8A, as the abutting block of the conventional bendable torque wrench in FIG. 1 and FIG. 2 has a flat surface for contact with the detent member, the detent member rotates relatively slow when the torque setting is reached; it follows that the wrench bends relatively slow, that the torque of the wrench vanishes relatively slow, and that the threaded fastener to which the wrench is applied will be subjected to the slowly reduced residual torque. The bendable torque wrench of the present invention, however, allows the detent member 90 to rotate faster than its prior art counterpart because of the contact between the curved abutting surface 721 of the abutting block 72 and the curved contact surface 93 of the detent member 90. Hence, once the force applied by the wrench of the invention reaches the torque setting, the wrench bends, or collapses, relatively fast as shown in FIG. 8B, and the torque of the wrench vanishes relatively fast as a result, lest the threaded fastener to which the wrench is applied be subjected to a slowly reduced residual torque. The wrench of the invention can bend, or collapse, rapidly and thereby allow its user to know immediately and clearly that the wrench has reached the preset torque value and that force application to the wrench should be stopped.

What is claimed is:

1. A bendable torque wrench, comprising:

a shank, a driving head provided at a front end of the shank; a first pivotal connection end and a second pivotal connection end both provided at a rear end of the shank, the first pivotal connection end and the second pivotal connection end are spaced apart;

a tubular body provided at a rear side of the shank, a front end of the tubular body angularly displaceable with respect to the shank about an axis defined by the first pivotal connection end of the shank;

an abutting block provided on one side of the tubular body, the abutting block has a front end provided with a convexly curved abutting surface;

an elastic element disposed in the tubular body; and a detent member having a front end pivotally connected to the second pivotal connection end of the shank such that the detent member is angularly displaceable about an axis defined by the second pivotal connection end, the detent member having a rear end provided with a convexly curved contact surface in contact with the convexly curved abutting surface of the abutting block; the abutting block and the detent member are brought into elastic contact with each other by an elastic force of the elastic element; the detent member is angularly displaceable with respect to the abutting block, and the shank and the tubular body are bendable with respect to each other;

wherein the convexly curved contact surface is a curved surface extending in an opposite direction from a curved surface of the convexly curved abutting surface.

2. The bendable torque wrench of claim 1, wherein the curved surfaces of the convexly curved contact surface and the convexly curved abutting surface having a same curvature or having different curvatures.

3. The bendable torque wrench of claim 1, wherein the torque wrench has a preset torque value, and the preset torque value is reached when an apex of the curved contact surface contacts an apex of the curved abutting surface.

4. The bendable torque wrench of claim 1, wherein the detent member has a positioning groove; a position limiting member extends into the positioning groove of the detent member, and the detent member is limited in position by the position limiting member when rotated.

5. The bendable torque wrench of claim 4, wherein the positioning groove of the detent member has a first end, a second end, and a transition between the first end and the second end, and the position limiting member is at the transition when the convexly curved contact surface of the detent member is at an apex of the convexly curved abutting surface of the abutting block.

6. The bendable torque wrench of claim 1, further comprising a stop block located on one side of the convexly curved abutting surface and adjacent to the tubular body, in order for the detent member to be stopped at a lateral side of the stop block when the detent member is rotated.

7. The bendable torque wrench of claim 6, wherein the stop block is protrudingly provided on one side of the abutting block.

8. The bendable torque wrench of claim 1, wherein the detent member has two sides defined respectively as a first side and a second side, the first side is adjacent to the tubular body, the second side is away from the tubular body; the convexly curved contact surface of the detent member and the convexly curved abutting surface of the abutting block contact each other at an initial contact point when no force is applied to the torque wrench, and the farther the distance between the initial contact point and the second side of the detent member, the bigger the bending angle of the torque wrench.

9. The bendable torque wrench of claim 1, wherein the curved surface of the convexly curved abutting surface of the abutting block is a curved surface that has a single or non-single curvature or is a curved surface with continuous or non-continuous curvatures.

10. The bendable torque wrench of claim 1, wherein the curved surface of the convexly curved contact surface of the detent member is a curved surface that has a single or non-single curvature or is a curved surface with continuous or non-continuous curvatures.

11. The bendable torque wrench of claim 1, further comprising:

a connecting member having a front end pivotally connected to the first pivotal connection end of the shank, the connecting member having a rear end extending into the tubular body; and an adjusting member threadedly connected to the rear end of the connecting member;

the elastic element has one end abutting against the tubular body and an opposite end abutting against the adjusting member.

* * * * *